US009435560B2

(12) United States Patent
Kobayashi

(10) Patent No.: US 9,435,560 B2
(45) Date of Patent: Sep. 6, 2016

(54) AIR-CONDITIONER CONTROL INTERFACE DEVICE, AIR CONDITIONER, AND AIR-CONDITIONER CONTROL SYSTEM

(75) Inventor: Yuki Kobayashi, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 936 days.

(21) Appl. No.: 13/416,248

(22) Filed: Mar. 9, 2012

(65) Prior Publication Data

US 2012/0239204 A1 Sep. 20, 2012

(30) Foreign Application Priority Data

Mar. 16, 2011 (JP) ..... 2011-058612

(51) Int. Cl.
*G05D 23/00* (2006.01)
*F24F 11/00* (2006.01)

(52) U.S. Cl.
CPC ..... *F24F 11/006* (2013.01); *F24F 11/0086* (2013.01); *F24F 2011/0061* (2013.01)

(58) Field of Classification Search
CPC ..... F24F 11/04; F24F 11/006; F24F 11/00; F24F 11/1112; F24F 11/0012; F24F 11/0015; F24F 11/0079; F24F 11/0086; F24F 11/0009; F24F 2011/0061; F24F 2011/0067; F24F 2011/0068; F24F 2011/0002; F24F 2011/0013; F24F 3/065; F24F 3/00; F24F 1/0003; Y02B 30/746; G05D 23/00; G05D 23/19; G05D 23/1905; G05D 23/27511
USPC ..... 700/276; 62/163, 151, 175, 298
See application file for complete search history.

(56) References Cited

U.S. PATENT DOCUMENTS 5,349,660 A 9/1994 Sutula et al.
6,192,282 B1 * 2/2001 Smith et al. ..... 700/19

(Continued)

FOREIGN PATENT DOCUMENTS

JP 05-346332 A 12/1993
JP 6-221653 A 8/1994

(Continued)

OTHER PUBLICATIONS

Office Action issued on Feb. 8, 2014, by the Chinese Patent Office in corresponding Chinese Patent Application No. 201210069989.2 and an English translation of the Office Action. (19 pages).

(Continued)

*Primary Examiner* — Robert Fennema
*Assistant Examiner* — Md N Mia
(74) *Attorney, Agent, or Firm* — Buchanan Ingersoll & Rooney PC

(57) ABSTRACT

An air-conditioner control interface device that connects an air conditioner to an external device, including: an air-conditioner-information input/output unit that transmits or receives information to or from the air conditioner; an external-device-information input/output unit that transmits or receives information to or from the external device; an interface-control-information input/output unit that acquires interface control information, in which definitions of the information transmitted or received between the external device and the air conditioner and methods of transmitting or receiving the information, are described; and an interface controller that controls the external-device-information input/output unit and the air-conditioner-information input/output unit to transmit or receive information based on the interface control information.

28 Claims, 7 Drawing Sheets

(56) References Cited

U.S. PATENT DOCUMENTS

| | | | | |
|---|---|---|---|---|
| 6,216,956 | B1 * | 4/2001 | Ehlers et al. | 236/47 |
| 2004/0107717 | A1 * | 6/2004 | Yoon et al. | 62/230 |
| 2005/0093501 | A1 * | 5/2005 | Takahashi et al. | 318/568.13 |
| 2007/0225868 | A1 * | 9/2007 | Terlson et al. | 700/276 |
| 2007/0278320 | A1 * | 12/2007 | Lunacek et al. | 236/94 |
| 2009/0195349 | A1 * | 8/2009 | Frader-Thompson et al. | 340/3.1 |
| 2010/0070089 | A1 * | 3/2010 | Harrod et al. | 700/277 |
| 2011/0054710 | A1 * | 3/2011 | Imes et al. | 700/286 |
| 2012/0158159 | A1 | 6/2012 | Kuroiwa et al. | |

FOREIGN PATENT DOCUMENTS

| | | | |
|---|---|---|---|
| JP | 2002-22248 | A | 1/2002 |
| JP | 2002-215221 | A | 7/2002 |
| JP | 2003-240317 | A | 8/2003 |
| JP | 2004-094432 | A | 3/2004 |
| JP | 2007-85707 | A | 4/2007 |
| JP | 2008-288980 | A | 11/2008 |
| JP | 2009-133549 | A | 6/2009 |
| WO | 2011/027587 | A1 | 3/2011 |

OTHER PUBLICATIONS

Office Action (Notice of Rejection) issued on Feb. 18, 2014, by the Japanese Patent Office in corresponding Japanese Patent Application No. 2011-058612 and an English translation of the Office Action. (6 pages).

Office Action (Notice of Rejection) issued on Sep. 30, 2014, by the Japanese Patent Office in corresponding Japanese Patent Application No. 2011-058612, and a partial English translation of the Office Action. (4 pages).

* cited by examiner

FIG.3

13

NAME OF VARIABLE
・OPERATION:POWER
OPERATING:POWER=ON
NOT OPERATING:POWER=OFF
・ROOM TEMPERATURE:TEMP
10°C:10
:
30°C:30
・OPERATION MODE:MODE
HEATING:HEAT

FIG.4

14

```
IF(POWER=OFF&TEMP<20)//WHEN NOT OPERATING AND ROOM TEMPERATURE IS 20°C OR LESS
{
  MODE=HEAT
  POWER=ON          //OPERATION IS STARTED WITH OPERATION MODE HEATING
}
```

AIR-CONDITIONER CONTROL INTERFACE DEVICE, AIR CONDITIONER, AND AIR-CONDITIONER CONTROL SYSTEM

BACKGROUND OF THE INVENTION

1. Field of the Invention

The present invention relates to an air-conditioner control interface device, an air conditioner, and an air-conditioner control system.

2. Description of the Related Art

When information on an air conditioner such as operating information and control information is output to an external device (such as a personal computer, a card key, a coin timer, and a general-purpose centralized controller), there is a case where externally output information is fixed when the air conditioner is designed to have a simple configuration. Furthermore, in order to increase information output to the external device, there is a case where the air conditioner is designed to meet a certain demand; for example, the air conditioner includes a plurality of external-device output units or changes output contents using a switch, a jumper or the like.

There are some air conditioners that automatically create a control program in response to each user's use environment and rewrite control information or the like (see, for example, Japanese Patent Application Laid-open No. 2002-22248), and other types of air conditioners that rewrite data stored in an auxiliary storage device such as an electrically erasable programmable read only memory (EEPROM) using a wireless remote controller or a key switch (see, for example, Japanese Patent Application Laid-open No. H6-221653).

When the operating information or the like is input or output between the air conditioner and the external device, the air conditioner includes a function for this information input/output in one case and the information input/output is performed between the air conditioner and the external device via an air-conditioner control interface (an air-conditioner control interface device) in another case.

However, the conventional techniques have the following problems. When the air conditioner has a simplified configuration, input/output contents are limited. Meanwhile, for increasing output contents, the air conditioner needs to include a plurality of external-device output units, which makes the control board of the air conditioner or the air-conditioner control interface large in size. In addition, for changing the output contents, a plurality of switches or jumpers need to be provided on the control board of the air conditioner and on the board of the air-conditioner control interface. As a result, there is a problem in that the boards are disadvantageously made large and the manufacturing cost thereof increases. For suppressing the increase in the size of the boards and the increase in the manufacturing cost, input/output contents are fixed and a user cannot arbitrarily customize the input/output information. As a result, there is another problem in that the air conditioner is limited to certain applications and that control information created by a user or a service provider cannot be commonly used in a plurality of air conditioners. That is, the air conditioner has a poor scalability and cannot flexibly meet various needs of the user. Furthermore, if the input/output information is fixed, it is necessary to change software or hardware for the control board of the air conditioner and for the air-conditioner control interface whenever different information is input or output.

Furthermore, the methods disclosed in Japanese Patent Application Laid-open No. 2002-22248 and Japanese Patent Application Laid-open No. H6-221653 require a technique of automatically creating a control program in response to the user's use environment or rewriting data stored in the auxiliary storage device such as the EEPROM by using a wireless remote controller or a key switch. As a result, there is a problem in that the manufacturing cost of the air-conditioner main body increases.

SUMMARY OF THE INVENTION

It is an object of the present invention to at least partially solve the problems in the conventional technology.

There is provided an air-conditioner control interface device according to an aspect of the present invention that connects an air conditioner to an external device, including: an air-conditioner-information input/output unit that transmits or receives information to or from the air conditioner; an external-device-information input/output unit that transmits or receives information to or from the external device; an interface-control-information input/output unit that acquires interface control information, in which definitions of the information transmitted or received between the external device and the air conditioner and methods of transmitting or receiving the information, are described; and an interface controller that controls the external-device-information input/output unit and the air-conditioner-information input/output unit to transmit or receive information based on the interface control information.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is an example of released variables according to the second embodiment such as operating information;

FIG. 4 is an example of control logical description information according to the second embodiment;

DETAILED DESCRIPTION OF THE PREFERRED EMBODIMENTS

Exemplary embodiments of an air-conditioner control interface device, an air conditioner, and an air-conditioner control system according to the present invention will be explained below in detail with reference to the accompanying drawings. The present invention is not limited to the embodiments.

First Embodiment

Figure 1:
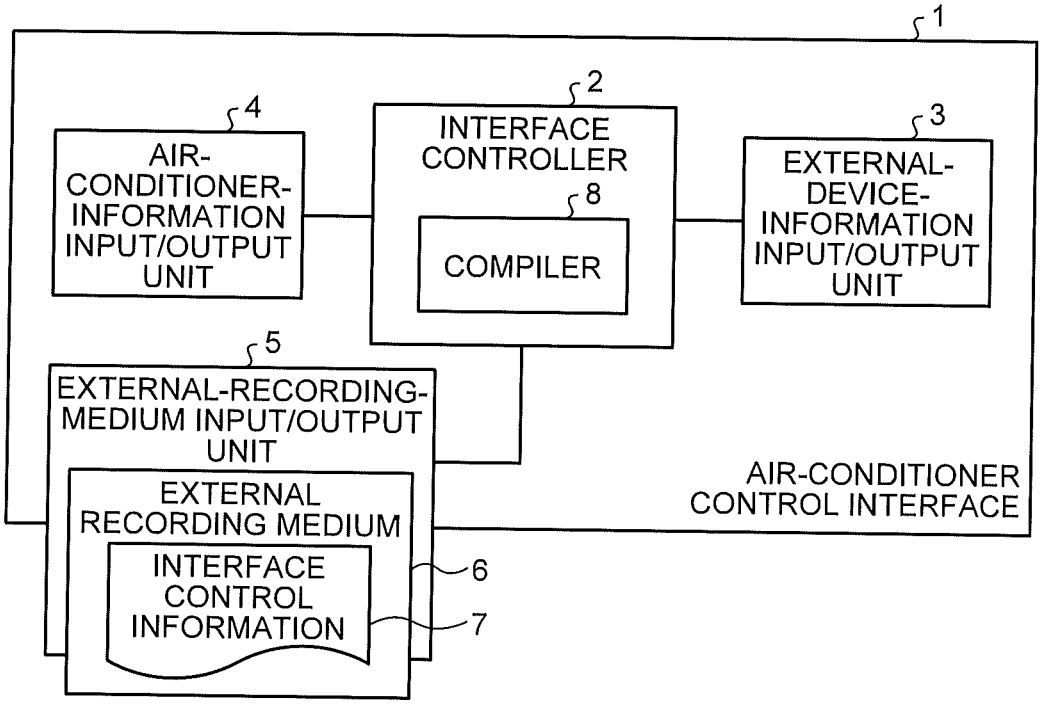
FIG. 1 is a functional configuration example of an air-conditioner control interface according to a first embodiment of the present invention.

FIG. 1 is a functional configuration example of an air-conditioner control interface (air-conditioner control interface device) 1 according to a first embodiment of the present invention. As shown in FIG. 1, the air-conditioner control interface 1 includes an interface controller 2, an external-device-information input/output unit 3 that transmits or receives information to or from an external device, an air-conditioner-information input/output unit 4 that transmits or receives information to or from an air conditioner, and an external-recording-medium input/output unit (interface-control-information input/output unit) 5. The air-conditioner control interface 1 transmits or receives operating information or the like to or from the air conditioner when being connected to the air conditioner, and transmits or receives operating information or the like to or from the external device when being connected to the external device.

The external-recording-medium input/output unit 5 can accommodate an external recording medium 6, and is connected to the external recording medium 6 when accommodating the external recording medium 6. The external recording medium 6 stores therein interface control information 7 arbitrarily created by a user. The external-recording-medium input/output unit 5 reads the interface control information 7 from the external recording medium 6 and inputs the interface control information 7 to the interface controller 2. The interface control information 7 is information (for example, a source code compiled into an executable form) for performing an operation for transmitting or receiving information between the air conditioner and the external device, that is, transmitting air-conditioner manipulating information to the external device or for transmitting the operating information on the air conditioner from the external device to the air conditioner. That is, the interface control information 7 is information in which definitions of the information transmitted or received between the air conditioner and the external device and methods of transmitting and receiving are described. Information acquired from the air conditioner and that transmitted from the external device to the air conditioner are defined based on the interface control information 7.

The interface controller 2 includes a compiler 8 that interprets the interface control information 7 input from the external-recording-medium input/output unit 5 and converts the interface control information 7 into a control command for controlling the interface of the air conditioner.

An operation according to the first embodiment is explained next. In the air-conditioner control interface 1 according to the first embodiment, the air-conditioner-information input/output unit 4 inputs information output from the air conditioner such as the operating information on the air conditioner to the interface controller 2, and outputs the information input from the external device such as air-conditioner manipulating information to the air conditioner. The external-device-information input/output unit 3 outputs information output from the air conditioner such as the operating information on the air conditioner to the external device, and inputs the information input from the external device such as the air-conditioner manipulating information to the interface controller 2.

The external recording medium 6 stores therein the interface control information 7 arbitrarily created by a user. The external-recording-medium input/output unit 5 reads the interface control information 7 from the external recording medium 6 and inputs the read interface control information 7 to the interface controller 2.

The interface controller 2 interprets the interface control information 7 as the control command by using the compiler 8, and performs an operation in response to the control command. Specifically, the interface controller 2 outputs the operating information or the like acquired from the air conditioner via the air-conditioner-information input/output unit 4 to the external device via the external-device-information input/output unit 3 based on the control command. The interface controller 2 then transmits air-conditioner manipulating information or the like acquired from the external-device-information input/output unit 3 to the air conditioner via the air-conditioner-information input/output unit 4 based on the control command.

As described above, according to the first embodiment, the interface controller 2 interprets the interface control information 7 arbitrarily set by a user, transmits the operating information or the like on the air conditioner to the external device based on the interpreted control content, and transmits the air-conditioner manipulating information or the like input from the external device to the air conditioner. Therefore, the air-conditioner control interface 1 does not need to include a plurality of external-device-information input/output units and a switching unit for changing the external-device-information input/output units, such as a switch or a jumper. Therefore, the air-conditioner control interface 1 can handle various needs for the externally input/output information on the air conditioner while suppressing a cost increase. Furthermore, the definition of information transmitted or received and the input/output method for the information can be changed only by changing the interface control information 7. Therefore, it is possible to commonly use software and hardware for the air-conditioner control interface 1 irrespective of the type of the air conditioner, that of the external device or the like, and to meet the diversified needs of users.

Second Embodiment

An air-conditioner control method according to a second embodiment of the present invention is explained next. In the first embodiment, it has been explained that a user or a service provider stores the interface control information 7 in the external recording medium 6 in advance. In the second embodiment, a method by which a user or a service provider creates the interface control information 7 is explained.

Figure 2:
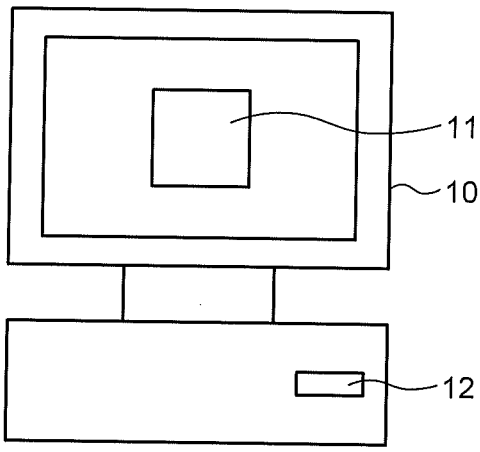
FIG. 2 is a configuration example of an information processor according to a second embodiment of the present invention.

FIG. 2 is a configuration example of an information processor 10 according to the second embodiment. The information processor 10 as well as the air-conditioner control interface 1 according to the first embodiment constitutes a control system for the air conditioner (air-conditioner control system). The air-conditioner control system as well as the air conditioner constitutes an air-conditioning system. FIG. 3 is an example of released variables according to the second embodiment such as operating information. FIG. 4 is an example of released control logical description information according to the second embodiment based on a released control logical description form.

For example, the information processor 10 is a general computer, and includes a controller such as a central processing unit (CPU), an input/output unit such as a keyboard or a monitor, a storage unit that stores therein information, or the like. The information processor 10 also includes a text editor 11 incorporated therein as a standard feature and an external-recording-medium input/output unit 12 that writes information to the external recording medium 6 and reads information written to the external recording medium 6. The text editor 11 operates under control of the controller of the information processor 10, outputs information in an electronic file form stored in a designated storage unit to a monitor in response to an input from a keyboard, and changes the information based on another user's input.

The storage unit of the information processor 10 stores therein variables information 13 that is information on variables such as definable operating information and manipulating information released by a manufacturer or the like of the air conditioner, as exemplified in FIG. 3. This variables information 13 is not necessarily stored in the storage unit of the information processor 10 and suffices to be recognized by a user. For example, the variables information 13 can be released to a paper medium and recognized by a user.

The storage unit of the information processor 10 also stores therein control logical description information 14, as shown in FIG. 4, for describing a control logic expression by combining the variables as shown in FIG. 3. It is assumed here that the manufacturer or the like of the air conditioner releases a control logical description form for creating the control logical description information 14 and a sample source code of the control logical description information 14.

A user creates the control logical description information 14 with the text editor 11 based on the variables information 13 and the control logical description form released from the manufacturer or the like of the air conditioner, or edits the control logical description information 14 provided as the sample source code from the manufacturers or the like in advance as a standard feature. The created or edited control logical description information 14 is stored in the external recording medium 6 as the interface control information 7. The external recording medium 6 is connected to the external-recording-medium input/output unit 5 explained in the first embodiment, whereby the air-conditioner control interface 1 according to the first embodiment can operate.

In the second embodiment, it is explained that a user creates the interface control information 7 using the text editor 11 incorporated in the information processor 10 as a standard feature. However, the method of creating the interface control information 7 is not limited to the method using the text editor 11. Alternatively, the interface control information 7 can be created by using other software as long as the information processor 10 includes the software as a standard feature.

As described above, a user or a service provider can arbitrarily create the interface control information 7 using variables representing the operating information and manipulating information on the air conditioner and control logical description form that are released in advance. Therefore, the information processor 10 according to the second embodiment can achieve effects same as those of the first embodiment and meet various needs of users without using any dedicated software or hardware.

Third Embodiment

An air-conditioner control method according to a third embodiment of the present invention is explained next. In the second embodiment, it has been explained that a user or a service provider creates the interface control information 7 by using the text editor 11 included in the information processor 10 as a standard feature while using released variables and control logical description form. The use of the text editor 11 is advantageous in that no additional cost is required but is often poor in operability when creating the interface control information 7.

Figure 5:
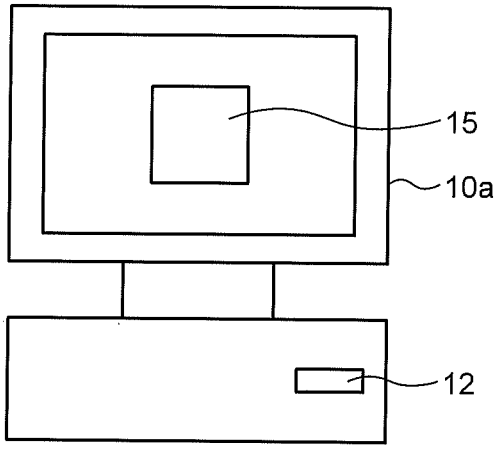
FIG. 5 is a configuration example of an information processor according to a third embodiment of the present invention.

FIG. 5 is a configuration example of an information processor 10*a* according to the third embodiment. The information processor 10*a* as well as the air-conditioner control interface 1 according to the first embodiment constitutes an air-conditioner control system. The information processor 10*a* according to the third embodiment includes not only functions similar to those of the information processor 10 according to the second embodiment but also a dedicated software tool 15 for creating the interface control information 7. For example, the dedicated software tool 15 is created by the manufacturer or the like of the air conditioner and installed to the information processor 10*a* by a user or the like.

The specifications of the dedicated software tool 15 can be arbitrarily set as long as the dedicated software tool 15 is designed such that a user can easily create and update the interface control information 7 by screen display or the like. For example, a list of operating information, manipulating information or the like is displayed on a screen of the information processor 10*a* so that the user can make setting and addition, and the user is allowed to easily select them using a mouse or a button on the screen.

The interface control information 7 created by the dedicated software tool 15 is stored in the external recording medium similarly to the second embodiment. The external recording medium is connected to the external-recording-medium input/output unit 5 described in the first embodiment, whereby the operation according to the first embodiment can be done.

As described above, according to the third embodiment, the interface control information 7 is created using the dedicated software tool 15 for creating the interface control information 7. Therefore, a user or a service provider can easily create the interface control information 7 without deriving any control logic expression for the interface.

Fourth Embodiment

An air-conditioner control method according to a fourth embodiment of the present invention is explained next. In the second and third embodiments, it has been explained that the interface control information 7 is transmitted to the air-conditioner control interface 1 by storing the interface control information 7 created by a user or a service provider in the external recording medium. Furthermore, the external-recording-medium input/output unit 5 of the air-conditioner control interface 1 functions as an interface-control-information input/output unit that inputs or outputs the interface control information 7. In the fourth embodiment, an information processor directly transmits the interface control information 7 to an air-conditioner control interface 1*a*.

Figure 6:
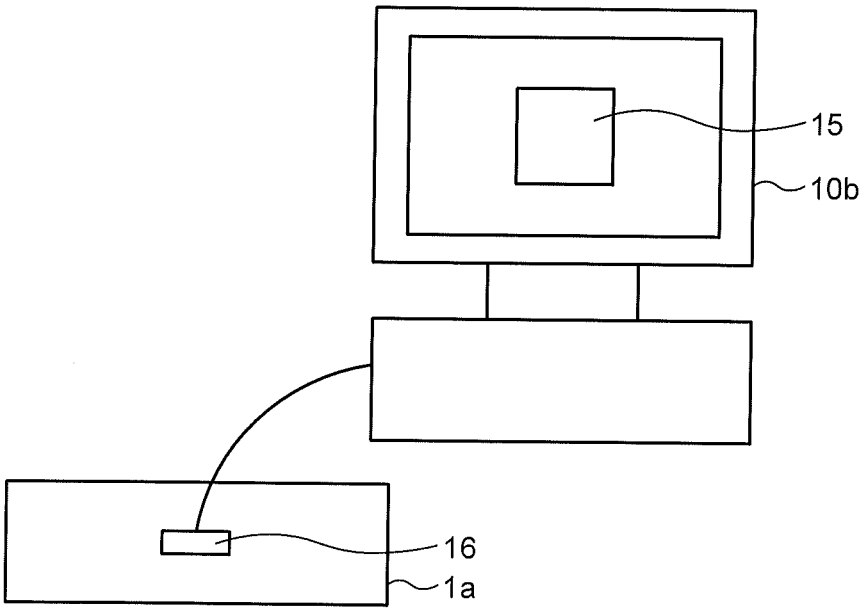
FIG. 6 is a configuration example of an air-conditioner control system according to a fourth embodiment of the present invention.

FIG. 6 is a configuration example of an air-conditioner control system according to the fourth embodiment. The air-conditioner control system according to the fourth embodiment includes the information processor 10*b* and the air-conditioner control interface 1*a*. The information processor 10*b* includes the dedicated software tool 15 explained in the third embodiment (or the text editor 11 explained in the first embodiment). The information processor 10*b* is connected to the air-conditioner control interface 1*a*.

The information processor 10*b* includes a standard communication function, and transmits the interface control information 7 to the air-conditioner control interface 1*a* using the communication function. The air-conditioner control interface 1*a* is similar to the air-conditioner control interface 1 according to the first embodiment except for including an information processor input/output unit 16 in place of the external-recording-medium input/output unit 5 according to the first embodiment. In the first embodiment, the information processor input/output unit 16 functions as an interface-control-information input/output unit. The air-conditioner control interface 1*a* can further include the external-recording-medium input/output unit 5.

In the air-conditioner control interface 1*a*, the information processor input/output unit 16 receives the interface control information 7 transmitted from the information processor 10*b*, performs a predetermined receiving process on the interface control information 7, and then outputs the resultant interface control information 7 to the interface controller 2. It suffices that the air-conditioner control interface 1*a* includes a communication conversion adapter that converts forms of input/output signals to or from the information processor 10*b* and those of input/output signals to or from the air-conditioner control interface 1*a* as the information processor input/output unit 16.

As described above, according to the fourth embodiment, the air-conditioner control interface 1*a* can acquire the interface control information 7 directly from the information processor 10*b* not via the external recording medium. Therefore, there is no need to prepare the external recording medium that stores therein the interface control information 7, and the interface control information 7 can be promptly transmitted or received.

Fifth Embodiment

An air-conditioner control method according to a fifth embodiment of the present invention is explained next. In the second and third embodiments, it has been explained that a user or a service provider creates the interface control information 7 by using either the text editor 11 of the information processor 10 or software such as the dedicated software tool 15 of the information processor 10*a*. In the fifth embodiment, a user or a service provider accesses the Internet via the information processor and creates the interface control information 7 using a software tool on a server.

Figure 7:
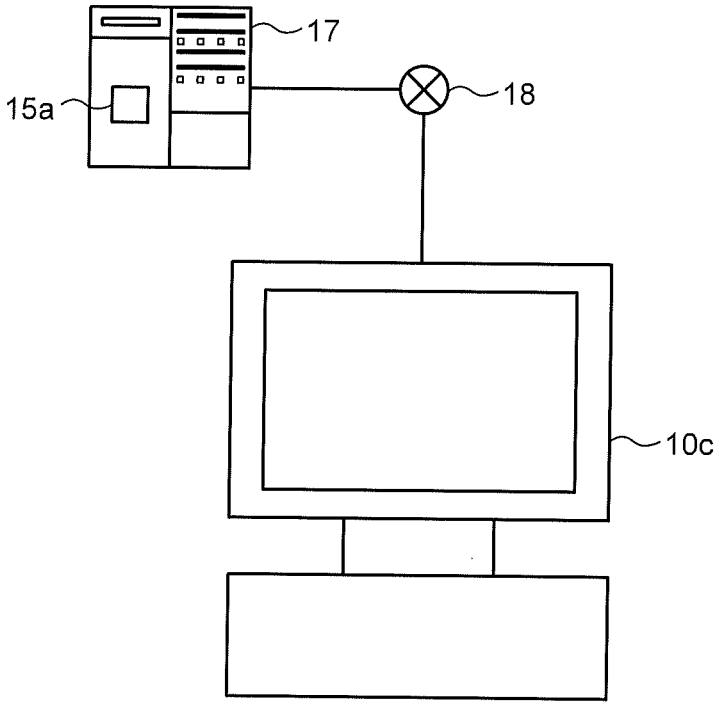
FIG. 7 is a configuration example of an air-conditioner control system according to a fifth embodiment of the present invention.

FIG. 7 is a configuration example of an air-conditioner control system according to the fifth embodiment. The air-conditioner control system according to the fifth embodiment includes an information processor 10*c* and a server 17. The information processor 10*c* is connected to the server 17 via a network 18 such as the Internet. Furthermore, although not shown in FIG. 7, the air-conditioner control interface 1 according to the first embodiment as well as the information processor 10*c* constitutes an air-conditioner control system according to the fifth embodiment. In the fifth embodiment, as explained in the first to third embodiments, the interface control information 7 is transmitted or received via the external recording medium. Alternatively, an operation similar to that performed by the air-conditioner control system according to the fifth embodiment can be applied to a configuration in which the information processor 10*b* is directly connected to the air-conditioner control interface 1*a* as explained in the fourth embodiment.

The server 17 includes a dedicated software tool 15*a* that enables a user or a service provider to easily create the interface control information. While the dedicated software tool 15*a* is similar to the dedicated software tool 15 according to the third embodiment, contents or the like of the dedicated software tool 15*a* are displayed on a screen of the information processor 10*c* and the input units (such as a keyboard or a mouse) of the information processor 10*c* are used for inputting.

As described above, according to the fifth embodiment, a user or a service provider creates the interface control information 7 by using the dedicated software tool 15*a* on the server 17. Therefore, the user or the service provider does not need to prepare for the installation or the like of the dedicated software tool 15*a* to the information processor 10*c*. Furthermore, the user or the service provider does not need to download software or the like for update when the version of the dedicated software tool 15*a* is upgraded.

Sixth Embodiment

An air-conditioner control method according to a sixth embodiment of the present invention is explained next. In the first to fifth embodiments, it has been explained that the compiler 8 of the interface controller 2 included in the air-conditioner control interface 1 (or the air-conditioner control interface 1*a*) compiles the interface control information 7 and creates the control command. In the sixth embodiment, the interface control information 7 is compiled on an information processor 10*d* or the server.

Figure 8:
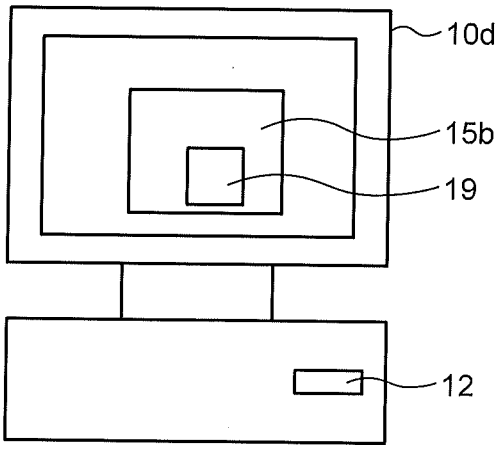
FIG. 8 is a configuration example of an information processor according to a sixth embodiment of the present invention.

FIG. 8 is a configuration example of the information processor 10*d* according to the sixth embodiment. The information processor 10*d* as well as the air-conditioner control interface 1 according to the first embodiment constitutes an air-conditioner control system. The information processor 10*d* according to the sixth embodiment includes a dedicated software tool 15*b* and the external-recording-medium input/output unit 12 similar to that according to the second embodiment. The dedicated software tool 15*b* includes a function similar to that of the dedicated software tool 15 according to the third embodiment and also includes a compiler 19. The dedicated software tool 15*b* converts the interface control information 7 created by similar procedures to those according to the third embodiment into the control command using the compiler 19. The external-recording-medium input/output unit 12 stores this control command in the external recording medium.

When the external recording medium that stores therein the control command is connected to the air-conditioner control interface 1, the external-recording-medium input/output unit 5 reads the control command from the external recording medium and outputs the control command to the interface controller 2. In the sixth embodiment, the interface controller 2 does not need to include the compiler 8.

It has been explained that the information processor 10*d* transmits the control command to the air-conditioner control interface 1 via the external recording medium. Alternatively, similarly to the fourth embodiment, the air-conditioning control interface 1*a* can be used instead of the air-conditioning control interface 1, and further the information processor 10*d* can be connected to the air-conditioner control interface 1*a* and directly transmit the control command.

Furthermore, FIG. 8 is an example in which the information processor 10*d* includes the compiler 19. Alternatively, similarly to the fifth embodiment, when the server 17 includes the dedicated software tool 15*a*, the dedicated software tool 15*a* of the server 17 can include a compiler and convert the interface control information 7 into the control command using the compiler.

As described above, according to the sixth embodiment, the software tool included in the information processor 10*d* or the server 17 compiles the interface control information 7. Therefore, the air-conditioner control interface 1 does not need any compiler for interpreting the interface control information, which can simplify the processing in the air-conditioner control interface 1. Furthermore, if the interface control information 7 created by a user or a service provider is incorrect in description, the user or the service provider can recognize a compiling error on the dedicated software tool and can easily notice a description error in the interface control information.

Seventh Embodiment

Figure 9:
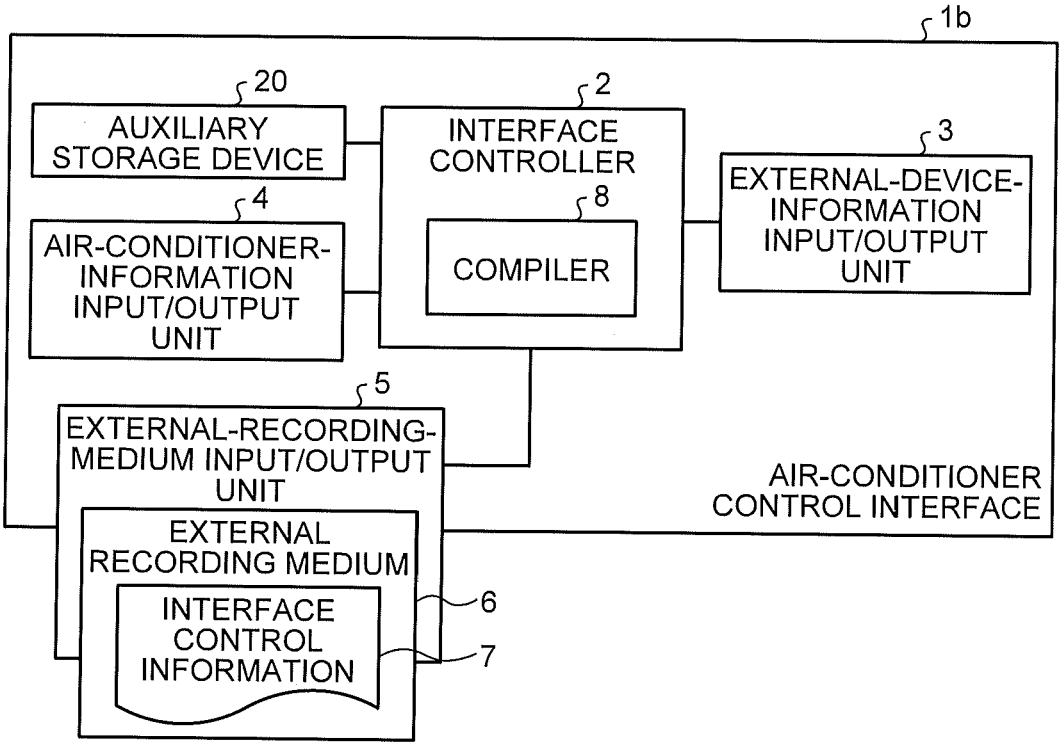
FIG. 9 is a functional configuration example of an air-conditioner control interface according to a seventh embodiment of the present invention.

FIG. 9 is a functional configuration example of an air-conditioner control interface 1*b* according to a seventh embodiment of the present invention. As shown in FIG. 9, the air-conditioner control interface 1*b* according to the seventh embodiment is similar to the air-conditioner control interface 1 according to the first embodiment except for additionally including an auxiliary storage device 20. Constituent elements having functions same as those in the first embodiment are denoted by like reference numerals in the first embodiment and redundant explanations thereof will be omitted.

In the first to sixth embodiments, it is necessary to attach (connect) the external recording medium 6 to the external-recording-medium input/output unit 5 so that the air-conditioner control interface 1 (or the air-conditioner control interface 1*a*) can hold the interface control information 7.

In the seventh embodiment, the air-conditioner control interface 1*b* includes the auxiliary storage device 20 so as to be able to hold the interface control information 7 even after detaching the external recording medium 6 from the external-recording-medium input/output unit 5. The interface controller 2 stores the interface control information 7 acquired from the external-recording-medium input/output unit 5 into the auxiliary storage device 20. Alternatively, the external-recording-medium input/output unit 5 can directly store the interface control information 7 into the auxiliary storage device 20.

In the seventh embodiment, the interface control information 7 is stored in the auxiliary storage device 20. Alternatively, the control command (either created by the compiler 8, provided by the external recording medium, or provided via direct communication) can be stored in the auxiliary storage device 20.

If the air-conditioner control interface 1*b* is directly connected to the information processor 10*b* not via the external recording medium as explained in the fourth embodiment, the interface controller 2 can store the interface control information 7 acquired from the information processor 10*b* in the auxiliary storage device 20.

As described above, according to the seventh embodiment, the air-conditioner control interface 1*b* includes the auxiliary storage device 20 and can hold the interface control information 7 in the auxiliary storage device 20. Therefore, the air-conditioner control interface 1*b* can read the interface control information 7 created by a user or a service provider even if it is detached from the external recording medium 6.

Eighth Embodiment

Figure 10:
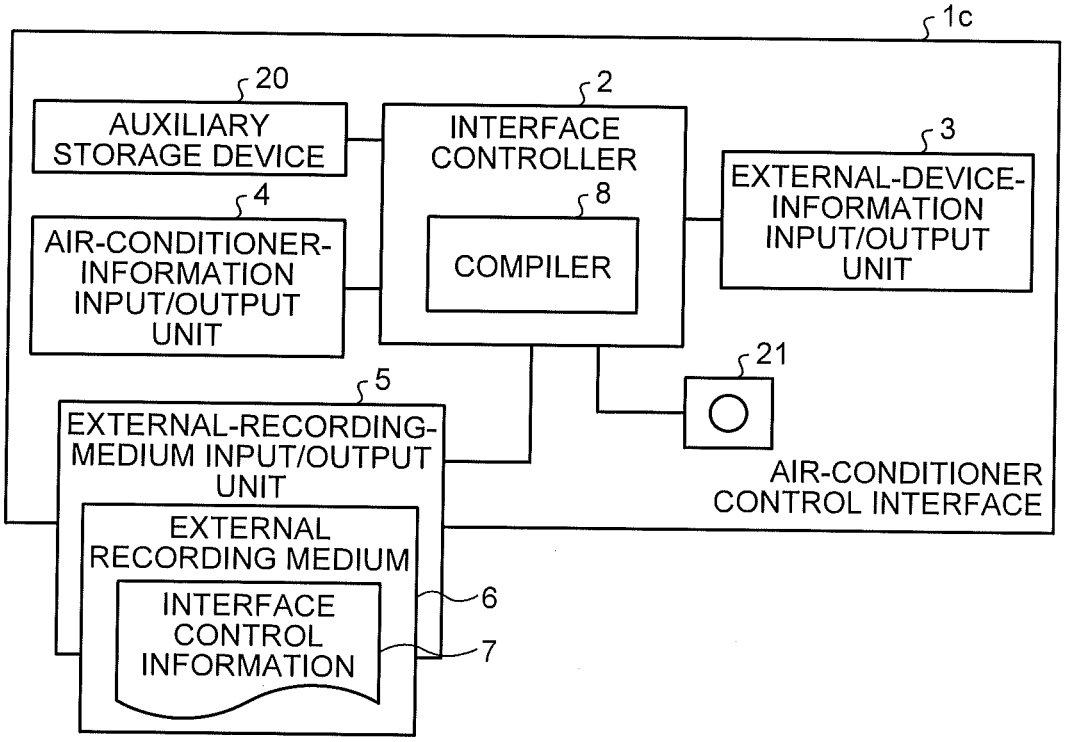
FIG. 10 is a functional configuration example of an air-conditioner control interface according to an eighth embodiment of the present invention.

FIG. 10 is a functional configuration example of an air-conditioner control interface 1*c* according to an eighth embodiment of the present invention. As shown in FIG. 10, the air-conditioner control interface 1*c* according to the eighth embodiment is same as the air-conditioner control interface 1*b* according to the seventh embodiment except for additionally including a switch (input unit) 21. Constituent elements having functions identical to those in the first or seventh embodiment are denoted by like reference numerals in the first embodiment and redundant explanations thereof will be omitted.

In the eighth embodiment, the interface control information 7 stored in the auxiliary storage device 20 can be written to the external recording medium. The air-conditioner control interface 1*c* includes the switch 21 such as a tact switch. By operating the switch 21, the interface controller 2 starts writing the interface control information 7 stored in the auxiliary storage device 20 to the external recording medium. Also, if the control command is stored in the auxiliary storage device 20, the interface controller 2 starts writing the control command to the external recording medium when the switch 21 is operated.

Furthermore, the interface controller 2 can directly transmit the interface control information 7 read from the auxiliary storage device 20 to the information processor 10*b* if the air-conditioner control interface 1*c* is connected to the information processor 10*b* not via the external recording medium.

As described above, according to the eighth embodiment, the interface control information 7 stored in the auxiliary storage device 20 is written to the external recording medium. With this configuration, even when the previously set interface control information 7 is not present because of missing or the like of the external recording medium 6 that stores therein the previously created interface control information 7, it is possible to obtain again the same interface control information 7.

Ninth Embodiment

Figure 11:
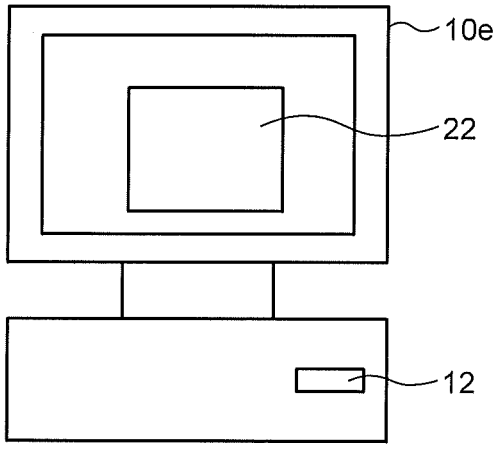
FIG. 11 is a configuration example of an information processor according to a ninth embodiment of the present invention.

FIG. 11 is a configuration example of an information processor 10*e* according to a ninth embodiment of the present invention. As shown in FIG. 11, the information processor 10*e* according to the ninth embodiment is similar to the information processor 10*d* according to the sixth embodiment except for including a dedicated software tool 22 in place of the dedicated software tool 15*b*.

When the air-conditioner control interface 1*c* described in the eighth embodiment is used and the control command is stored in the auxiliary storage device 20, a user or a service provider cannot directly recognize the contents of the control command even if the control command is stored in the external recording medium. To solve this problem, according to the ninth embodiment, the dedicated software tool 22 includes a recompiling function. The dedicated software tool 22 recompiles the control command and converts the control command into information the contents of which the user or the service provider can recognize. The dedicated software tool 22 displays the recompiled data on a monitor or the like of the information processor 10*e*. The user or the service provider can thereby recognize the control contents.

As described above, according to the ninth embodiment, the information processor 10*e* recompiles the interface control information 7 that has been compiled once, so that a user or a service provider can recognize the control contents. Therefore, the user or the service provider can recognize the control contents even if the previously set interface information is stored in the auxiliary storage device 20 in a compiled manner.

Tenth Embodiment

Figure 12:
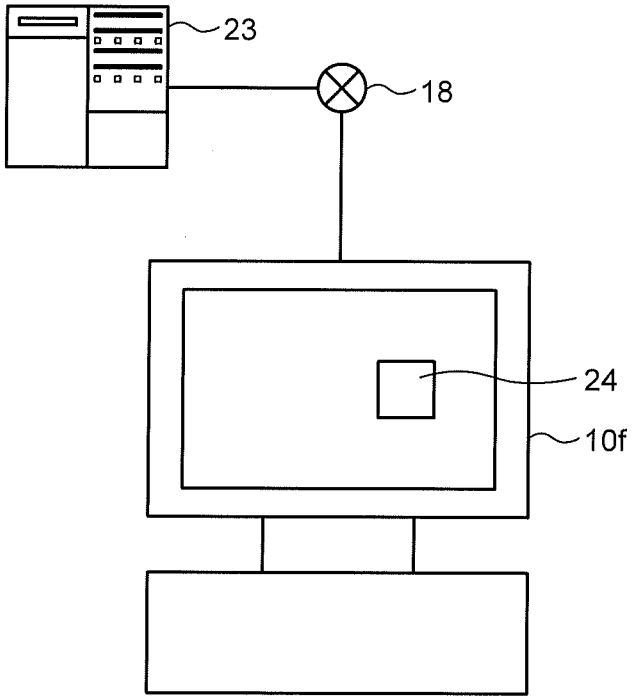
FIG. 12 is a configuration example of an air-conditioner control system according to a tenth embodiment of the present invention.

FIG. 12 is a configuration example of an air-conditioner control system according to a tenth embodiment of the present invention. As shown in FIG. 12, the air-conditioner control system according to the tenth embodiment includes an information processor 10*f* and an information sharing server 23. The information processor 10*f* is connected to the information sharing server 23 via the network 18 such as the Internet. Furthermore, although not shown in FIG. 12, the air-conditioner control interface 1 according to the first embodiment as well as the information processor 10*f* constitutes the air-conditioner control system according to the tenth embodiment. In the tenth embodiment, it is explained that, in the air-conditioner control interface 1 and the information processor 10*f*, the interface control information 7 is transmitted or received via the external recording medium. Alternatively, an operation similar to that performed by the air-conditioner control system according to the tenth embodiment can be applied to the configuration in which the information processor 10*b* is directly connected to the air-conditioner control interface 1*a* as described in the fourth embodiment.

In the first to ninth embodiments, it is necessary to create interface information 7 for each external device that each user or service provider connects to an air conditioner or air-conditioner control interface, or according to the requirement (demand) of each user.

Meanwhile, in the tenth embodiment, the information sharing server 23 holds the interface control information 7 created by a user or a service provider. The information processor 10*f* includes a software tool 24 capable of uploading and downloading the interface control information 7 held in the information sharing server 23. The user or the service provider can promptly create necessary interface control information 7 by using the interface control information 7 created by another user or another service provider as need arises.

As described above, according to the tenth embodiment, the information sharing server 23 holds the interface control information 7 developed by the different users or service providers, respectively. This enables each user or service provider to share the interface control information 7 with other users or service providers, and to create the interface control information 7 much faster than developing the interface control information 7 for each external device or according to the requirement (demand) of each user.

Eleventh Embodiment

In the first to tenth embodiments, the air-conditioner control interface 1 (or the air-conditioner control interface 1*a*, 1*b*, or 1*c*) is used when the information is input to or output from the external device. In an eleventh embodiment of the present invention, an indoor unit or an outdoor unit of the air conditioner includes functions corresponding to the air-conditioner control interface 1 (or the air-conditioner control interface 1*a*, 1*b*, or 1*c*) described in the first to tenth embodiments.

As described above, according to the eleventh embodiment, the indoor unit or the outdoor unit of the air conditioner includes functions corresponding to the air-conditioner control interface 1 (or the air-conditioner control interface 1*a*, 1*b*, or 1*c*) described in the first to tenth embodiments. Therefore, there is no need to separately manufacture the attached air-conditioner control interface 1 (or the air-conditioner control interface 1*a*, 1*b*, or 1*c*), and it is thereby possible to reduce the total cost for realizing the air conditioning system according to the eleventh embodiment as compared to the first to tenth embodiments.

The present invention can suppress an increase of manufacturing costs and meet diversified needs of users for externally input/output information on an air conditioner. In addition, the present invention can commonly use software and hardware.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An air-conditioner control interface device that communicates information between an air conditioner and an external device, comprising:

an air-conditioner-information input/output unit that transmits or receives information to or from the air conditioner;

an external-device-information input/output unit that transmits or receives information to or from the external device;

an interface-control-information input/output unit that retrieves stored predetermined interface control information, the interface control information including (1) definitions of air-conditioner manipulating information to be transmitted to the air conditioner from the external device and operating information on the air conditioner to be transmitted to the external device from the air conditioner and (2) methods by which respective information is received from the air conditioner and is to be transmitted to the external device and respective information is received from the external device and is to be transmitted to the air conditioner; and an interface controller that receives the interface control information from the interface-control-information input/output unit, interprets the interface control information and controls both the external-device-information input/output unit and the air-conditioner-information input/output unit to transmit the operating information on the air conditioner from the air conditioner to the external device and to transmit the air-conditioner manipulating information from the external device to the air conditioner based on (1) the definitions of the air-conditioner manipulating information and the operating information and (2) the methods by which respective information is received from the air conditioner and is to be transmitted to the external device and respective information is received from the external device and is to be transmitted to the air conditioner, included in the interpreted interface control information.

2. The air-conditioner control interface device according to claim 1, wherein the interface control information is configured to be arbitrarily created by a user based on released variables information and a released control logical description form, the released variables information indicating information transmittable to or receivable from the air conditioner and the external device.

3. The air-conditioner control interface device according to claim 1, further comprising an auxiliary storage unit that stores therein the interface control information, wherein the interface controller stores the interface control information received by the interface-control-information input/output unit into the auxiliary storage unit.

4. The air-conditioner control interface device according to claim 3, further comprising an input unit that receives an input to duplicate interface control information, wherein the interface controller reads the interface control information stored in the auxiliary storage unit and outputs the interface control information to a source of the interface-control-information via the interface-control-information input/output unit when the input unit receives the input to duplicate the interface control information.

5. The air-conditioner control interface device according to claim 1, wherein the interface control information is created using software included, as a standard feature, in an information processor.

6. The air-conditioner control interface device according to claim 1, wherein the interface control information is created using dedicated software included in an information processor for creating the interface control information.

7. The air-conditioner control interface device according to claim 1, wherein the interface control information is created using dedicated software for creating the interface control information, the dedicated software being included in a server connected to an information processor serving as an operation terminal.

8. The air-conditioner control interface device according to claim 6, wherein the dedicated software compiles the interface control information and converts the information into a control command, and the interface-control-information input/output unit acquires the control command as the interface control information.

9. The air-conditioner control interface device according to claim 7, wherein the dedicated software compiles the interface control information and converts the information into a control command, and the interface-control-information input/output unit acquires the control command as the interface control information.

10. The air-conditioner control interface device according to claim 3, wherein the interface control information is created using dedicated software for creating the interface control information, the dedicated software being included in an information processor.

11. The air-conditioner control interface device according to claim 4, wherein the interface control information is created using dedicated software for creating the interface control information, the dedicated software being included in an information processor.

12. The air-conditioner control interface device according to claim 3, wherein the interface control information is created using dedicated software for creating the interface control information, the dedicated software being included in a server connected to an information processor serving as an operation terminal.

13. The air-conditioner control interface device according to claim 4, wherein the interface control information is created using dedicated software for creating the interface control information, the dedicated software being included in a server connected to an information processor serving as an operation terminal.

14. The air-conditioner control interface device according to claim 10, wherein the dedicated software compiles the interface control information and converts the information into a control command, and the interface-control-information input/output unit acquires the control command as the interface control information.

15. The air-conditioner control interface device according to claim 11, wherein the dedicated software compiles the interface control information and converts the information into a control command, and the interface-control-information input/output unit acquires the control command as the interface control information.

16. The air-conditioner control interface device according to claim 12, wherein the dedicated software compiles the interface control information and converts the information into a control command, and the interface-control-information input/output unit acquires the control command as the interface control information.

17. The air-conditioner control interface device according to claim 13, wherein the dedicated software compiles the interface control information and converts the information into a control command, and the interface-control-information input/output unit acquires the control command as the interface control information.

18. The air-conditioner control interface device according to claim 14, wherein the dedicated software recompiles the control command.

19. The air-conditioner control interface device according to claim 15, wherein the dedicated software recompiles the control command.

20. The air-conditioner control interface device according to claim 16, wherein the dedicated software recompiles the control command.

21. The air-conditioner control interface device according to claim 17, wherein the dedicated software recompiles the control command.

22. The air-conditioner control interface device according to claim 1, wherein the interface-control-information input/output unit functions as an external-recording-medium input/output unit that reads the interface control information stored in an external recording medium.

23. The air-conditioner control interface device according to claim 1, wherein the interface-control-information input/output unit functions as an information-processor external input/output unit that acquires the interface control information created by an information processor via communication with the information processor.

24. The air-conditioner control interface device according to claim 1, wherein the interface control information is held in an information sharing server.

25. An air conditioner that functions as the air-conditioner control interface device according to claim 1.

26. An air-conditioner control system comprising:

an air-conditioner control interface device that communicates information between an air conditioner and an external device; and an information processor, wherein the air-conditioner control interface device includes:

an air-conditioner-information input/output unit that transmits or receives information to or from the air conditioner;

an external-device-information input/output unit that transmits or receives information to or from the external device;

an interface-control-information input/output unit that retrieves stored predetermined interface control information, the interface control information including (1) definitions of air-conditioner manipulating information to be transmitted to the air conditioner from the external device and operating information on the air conditioner to be transmitted to the external device from the air conditioner and (2) methods by which respective information is received from the air conditioner and is to be transmitted to the external device and respective information is received from the external device and is to be transmitted to the air conditioner; and an interface controller that receives the interface control information from the interface-control-information input/output unit, interprets the interface control information, and controls both the external-device-information input/output unit and the air-conditioner-information input/output unit to transmit the operating information on the air conditioner from the air conditioner to the external device and to transmit the air-conditioner manipulating information from the external device to the air conditioner based on (1) definitions of the air-conditioner manipulating information and the operating information and (2) the methods by which respective information is received from the air conditioner and is to be transmitted to the external device and respective information is received from the external device and is to be transmitted to the air conditioner, included in the interface control information, and wherein the information processor creates the interface control information.

27. An air-conditioner control system comprising:

an air-conditioner control interface device that communicates information between an air conditioner and an external device;

an information processor; and a server connected to the information processor, wherein the air-conditioner control interface device includes:

an air-conditioner-information input/output unit that transmits or receives information to or from the air conditioner;

an external-device-information input/output unit that transmits or receives information to or from the external device;

an interface-control-information input/output unit that retrieves stored predetermined interface control information, the interface control information including (1) definitions of air-conditioner manipulating information to be transmitted to the air conditioner from the external device and operating information on the air conditioner to be transmitted to the external device from the air conditioner and (2) methods by which respective information is received from the air conditioner and is to be transmitted to the external device and respective information is received from the external device and is to be transmitted to the air conditioner; and an interface controller that receives the interface control information from the interface-control-information input/output unit, interprets the interface control information and controls both the external-device-information input/output unit and the air-conditioner-information input/output unit to transmit the operating information on the air conditioner from the air conditioner to the external device and to transmit the air-conditioner manipulating information from the external device to the air conditioner based on (1) the definitions of the air-conditioner manipulating information and the operating information and (2) the methods by which respective information is received from the air conditioner and is to be transmitted to the external device and respective information is received from the external device and is to be transmitted to the air conditioner, included in the interpreted interface control information, wherein the server includes dedicated software for creating the interface control information, and wherein the air-conditioner control interface device acquires the interface control information created by the dedicated software via the information processor.

28. An air-conditioner control system comprising:

an air-conditioner control interface device that communicates information between an air conditioner and an external device;

an information processor; and an information sharing server, wherein the air-conditioner control interface device includes:

an air-conditioner-information input/output unit that transmits or receives information to or from the air conditioner;

an external-device-information input/output unit that transmits or receives information to or from the external device;

an interface-control-information input/output unit that retrieves stored predetermined interface control information, the interface control information including (1) definitions of air-conditioner manipulating information to be transmitted to the air conditioner from the external device and operating information on the air conditioner to be transmitted to the external device from the air conditioner and (2) methods by which respective information is received from the air conditioner and is to be transmitted to the external device and respective information is received from the external device and is to be transmitted to the air conditioner; and an interface controller that receives the interface control information from the interface-control-information input/output unit, interprets the interface control information and controls both the external-device-information input/output unit and the air-conditioner-information input/output unit to transmit the operating information on the air conditioner from the air conditioner to the external device and to transmit the air-conditioner manipulating information from the external device to the air conditioner based on (1) the definitions of the air-conditioner manipulating information and the operating information and (2)

the methods by which respective information is received from the air conditioner and is to be transmitted to the external device and respective information is received from the external device and is to be transmitted to the air conditioner, included in the interpreted interface control information, wherein the information processor creates the interface control information and transmits the created interface control information to the information sharing server, and wherein the information sharing server holds the interface control information received from the information processor, and transmits the held interface control information to the information processor in response to a request from the information processor.

* * * * *